US008496223B2

(12) United States Patent
Sladojevic et al.

(10) Patent No.: US 8,496,223 B2
(45) Date of Patent: Jul. 30, 2013

(54) SIDEFORM END SEAL OR CAP

(75) Inventors: Robert Sladojevic, Kent Town (AU); Steven Girotto, Kent Town (AU); Craig Deleon, Kent Town (AU)

(73) Assignee: SRB Construction Technologies Pty Ltd. (AU)

( * ) Notice: Subject to any disclaimer, the term of this patent is extended or adjusted under 35 U.S.C. 154(b) by 82 days.

(21) Appl. No.: 12/296,241

(22) PCT Filed: Mar. 28, 2007

(86) PCT No.: PCT/AU2007/000397

§ 371 (c)(1),
(2), (4) Date: Dec. 23, 2008

(87) PCT Pub. No.: WO02/40810

PCT Pub. Date: May 23, 2002

(65) Prior Publication Data

US 2010/0155571 A1 Jun. 24, 2010

(30) Foreign Application Priority Data

Apr. 7, 2006 (AU) ..... 2006901830

(51) Int. Cl.
*B28B 7/00* (2006.01)
*E04G 9/00* (2006.01)
*B22D 19/00* (2006.01)

(52) U.S. Cl.
USPC ..... 249/139; 249/189; 249/205; 52/127.6; 403/295; 403/308

(58) Field of Classification Search
USPC ..... 249/139, 187.1, 189, 205; 52/127.3, 52/127.6; 403/292, 295, 300, 308
See application file for complete search history.

(56) References Cited

U.S. PATENT DOCUMENTS

| | | | | |
|---|---|---|---|---|
| 3,822,858 | A | 7/1974 | Franklin | |
| 4,042,205 | A | 8/1977 | Herrell | |
| 4,557,091 | A * | 12/1985 | Auer | 52/282.3 |
| 5,015,117 | A * | 5/1991 | Pawlicki | 403/300 |
| 5,273,251 | A * | 12/1993 | Badstieber | 249/189 |
| 7,284,353 | B2 * | 10/2007 | Bealko | 52/656.5 |
| 2003/0084632 | A1 * | 5/2003 | Takagi et al. | 52/381 |
| 2005/0061948 | A1 * | 3/2005 | Brennan | 249/167 |

FOREIGN PATENT DOCUMENTS

| | | |
|---|---|---|
| AU | 661219 | 7/1995 |
| WO | WO 02/40810 | 5/2002 |
| WO | WO 2005/116365 A1 * | 12/2005 |

OTHER PUBLICATIONS

ISA/AU, International Search Report for International Application No. PCT/AU2007/000397, May 25, 2007.

* cited by examiner

*Primary Examiner* — Dimple Bodawala
(74) *Attorney, Agent, or Firm* — Beem Patent Law Firm

(57) ABSTRACT

A sideform molding accessory (10) includes a cap member (12) for capping an end (14) of a sideform (16). The cap member (12) includes a pair of opposed sides (12.1) and (12.2) and a peripheral portion (13) with at least a part of a profile (18) of the peripheral portion (13) complementing a molding surface (20) of the sideform (16) A retaining member (22) extends from one of the sides (12.2) of the cap member (12) for retaining the cap member (12) in position relative to the end (14) of the sideform (16).

6 Claims, 7 Drawing Sheets

SIDEFORM END SEAL OR CAP

CROSS-REFERENCE TO RELATED APPLICATIONS

The present application claims priority to Australian Provisional Patent Application No. 2006901830, filed on Apr. 7, 2006, the contents of which are incorporated herein by reference, and to PCT/AU2007/000397, filed on Mar. 28, 2007.

FIELD OF THE INVENTION

This invention relates to the casting of concrete panels or structures by use of sideform moulds. More particularly, the invention relates to a sideform moulding accessory in the form of an end seal or end cap.

BACKGROUND TO THE INVENTION

A concrete sideform system is commonly used to manufacture concrete panels and other concrete structures. Sideform systems are suitable for factory casting or site casting of panels.

Factory casting, also known as precasting, of concrete panels usually takes place on a large steel casting bed in a precast yard. The sizes and shapes of the panels are determined by sideforms that are arranged on the casting bed and concrete is poured into the space defined by the sideforms. When the concrete is dry, the sideforms are removed and the panels are lifted from the casting bed for transportation to a site for installation.

On-site or tilt-up casting of concrete panels usually occurs either on concrete slabs or on transportable steel beds. Again sideforms are used to define the size and shape of the panels. Due to space constraints, site casting frequently involves pouring several panels one on top of another. After the lowermost panel is dry it is coated with a release agent, and the sideforms are moved up to define a new panel of the same size or smaller before a second pour. The panels are subsequently lifted into position using a crane. The crane lifts the panels one at a time from the stack and moves them into position.

It is difficult to produce a sharp edge on cast concrete, since concrete is made up of granular particles and the sharpness of the corner is governed by the size of the particles. A sharp edge would also highlight formwork that is not perfectly straight and true and also such an edge would chip very easily. Accordingly, sideforms are commonly shaped to form a 45° chamfer along each edge of the panel.

In order to produce a mould for a panel, the sideforms must be arranged in either end-to-end abutment or transversely (usually perpendicularly) to each other. A combination of these arrangements is required to produce a complete mould. Ends of the sideforms are usually cut square to facilitate end-to-end abutment of sideforms. However, due to irregularities in sideforms and casting beds, gaps are often present between adjoining ends of sideforms arranged in end-to-end abutment.

For sideforms arranged perpendicularly to each other, the chamfer forming profile of a sideform does not match the square end of the abutting sideform and a gap is formed between the two sideforms. The most common method of reducing this gap is to modify the square end of the abutting sideform by cutting and grinding the end to match the chamfer forming profile. Again, irregularities result in gaps between the abutting sideforms.

In both end-to-end abutment and perpendicular abutment of sideforms, the gaps result in bleeding of the concrete mixture through the gaps when the concrete mixture is poured into the mould resulting in flaws in the cast panel.

For a sideform which has been modified, the end must be cut square again to enable the sideform to be arranged in end-to-end abutment with another sideform in subsequent use. Modification of sideforms to enable appropriate abutment gives rise to substantial costs in time, labour and productivity. It also causes wear and tear to plant equipment.

SUMMARY OF THE INVENTION

According to the invention there is provided a sideform moulding accessory, the accessory including:

a cap member for capping an end of a sideform, the cap member including a pair of opposed sides and a peripheral portion with at least a part of a profile of the peripheral portion complementing a moulding surface of the sideform; and a retaining member extending from one of the sides of the cap member for retaining the cap member in position relative to the end of the sideform.

The profile of the peripheral portion of the cap member may be shaped to permit arranging a plurality of capped sideforms in end-to-end abutment to form a substantially uninterrupted, extended moulding surface. Instead, the profile of the peripheral portion of the cap member may be shaped to permit one sideform, carrying the cap member in its end, to be arranged transversely to, and in abutment with, the moulding surface of another sideform.

The cap member may define a bearing surface. In use, when a first capped sideform and a second capped sideform are arranged in end-to-end abutment, the bearing surface of the cap member associated with the first sideform may bear against the bearing surface of the cap member associated with the adjacent, second sideform. An operatively rear part of the bearing surface may taper inwardly towards an operatively rear edge of the cap member to facilitate removal of the sideform after use.

The bearing surface of the cap member of the first capped sideform may abut the moulding surface of the other sideform when the first capped sideform is arranged transversely to a second sideform to form the junction.

A periphery of the retaining member may complement internal contours of the sideform so that the retaining member inhibits the ingress of material into an interior of the sideform, in use. The periphery of the retaining member may be arranged inwardly of the peripheral portion of the cap member to define a sealing surface about the retaining member. In use, the retaining member may be received in the end of the sideform with the sealing surface abutting the end of the sideform.

The cap member and the retaining member may be formed integrally with each other as a one piece unit. The unit may be a moulding of a resiliently flexible material, more particularly, an elastomeric material. The elastomeric material may be a natural or a synthetic rubber.

BRIEF DESCRIPTION OF THE DRAWINGS

Exemplary embodiments of sideform moulding accessories are now described with reference to the accompanying diagrammatic drawings in which:

FIG. 1(*b*) illustrates a perspective, front view of the sideform moulding accessory of FIG. 1(*a*);

FIG. 2(*b*) illustrates a perspective view of the end of the sideform capped with the accessory;

FIG. 3(*b*) illustrates the relative movement of the two capped sideforms of FIG. 3(*a*) during removal of the sideforms after use;

FIG. 4(*b*) illustrates a perspective, front view of the sideform moulding accessory of FIG. 4(*a*);

FIG. 5(*b*) illustrates a perspective view of the end of the sideform capped with the accessory;

FIG. 7(*b*) illustrates the end of the sideform of FIG. 7(*a*) capped with the accessory of FIG. 4(*a*).

DETAILED DESCRIPTION OF THE EXEMPLARY EMBODIMENTS

Figure 1B:
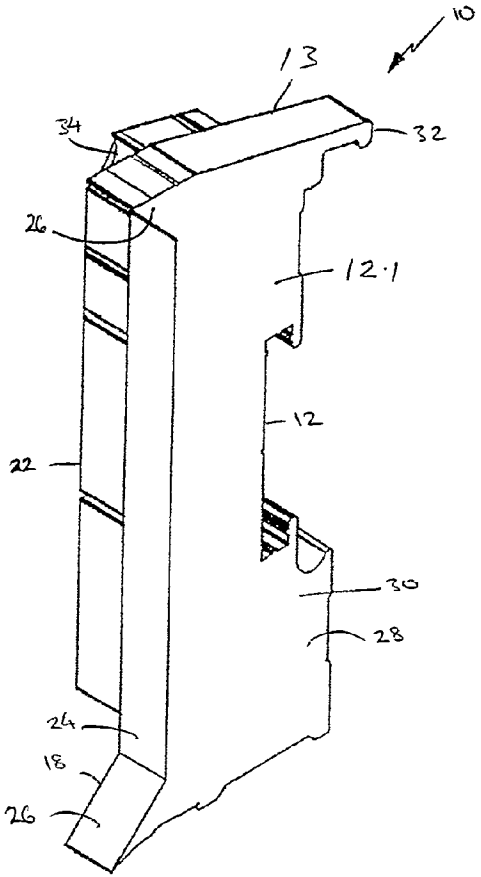
FIG. 1(*a*) illustrates a perspective, rear view of a sideform moulding accessory, in accordance with an embodiment of the invention, for use with sideforms which are arranged in end-to-end abutment.

In the drawings, reference numeral 10 generally designates a sideform moulding accessory, in accordance with an embodiment of the invention. The accessory 10 includes a cap member 12 for capping an end 14 (FIG. 2(*a*)) of a sideform 16. The cap member 12 has a pair of opposed sides 12.1 and 12.2 and a peripheral portion 13. At least a part of a profile 18 of the peripheral portion 13 complements a moulding surface 20 (FIG. 2(*a*)) of the sideform 16. The accessory 10 also includes a retaining member 22 which extends from the side 12.2 of the cap member 12 for retaining the cap member 12 in position relative to the end 14 of the sideform 16.

Figure 1A:
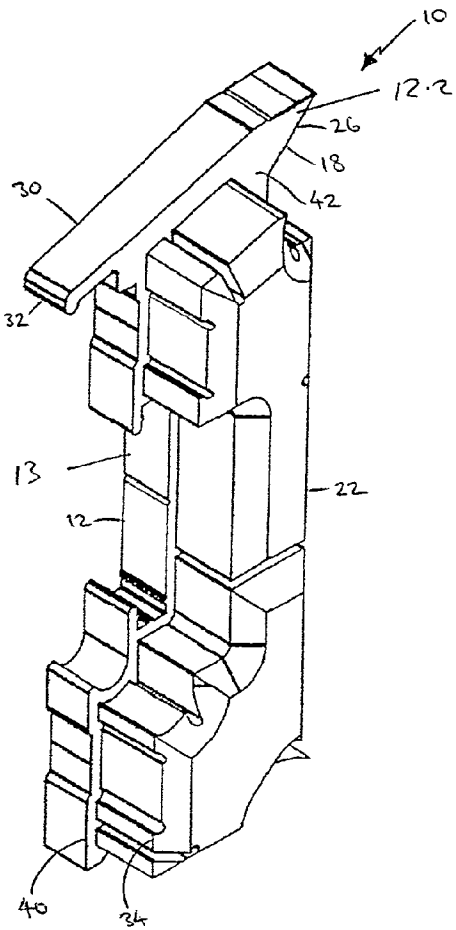

The profile 18 of the peripheral portion 13 of the cap member 12 illustrated in FIGS. 1(*a*) to 3(*b*) of the drawings is arranged to facilitate end-to-end abutment of a plurality of sideforms 16. The profile 18 defines a surface 24 having chamfered portions 26 configured so that the surface 24 matches the moulding surface 20 of the sideform 16. This allows a plurality of capped sideforms 16 to be arranged in end-to-end abutment to form a substantially uninterrupted, extended moulding surface 20.

The side 12.1 of the cap member 12 also defines a bearing surface 28 (FIG. 1(*b*)). In this embodiment, when a first capped sideform 16 and a second capped sideform 16 are arranged in end-to-end abutment, the bearing surface 28 of the cap member 12 associated with the first sideform 16 bears against the bearing surface 28 of the cap member 12 associated with the adjacent, second sideform 16.

Figure 3A:
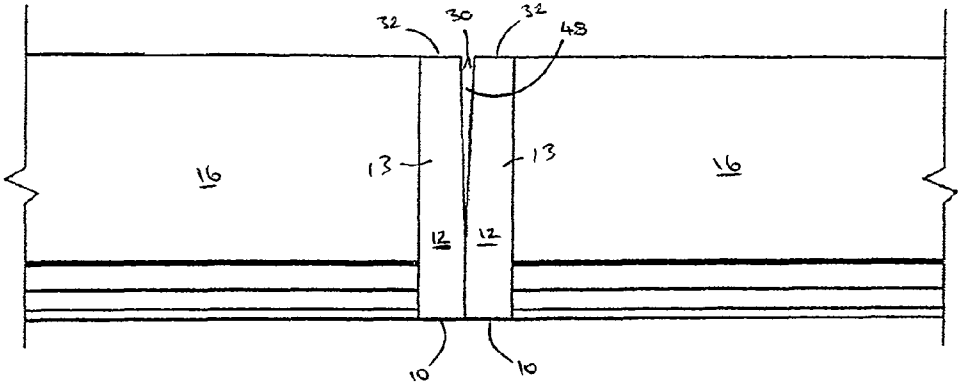
FIG. 3(*a*) illustrates a plan view of part of two capped sideforms arranged in end-to-end abutment.
Figure 3B:
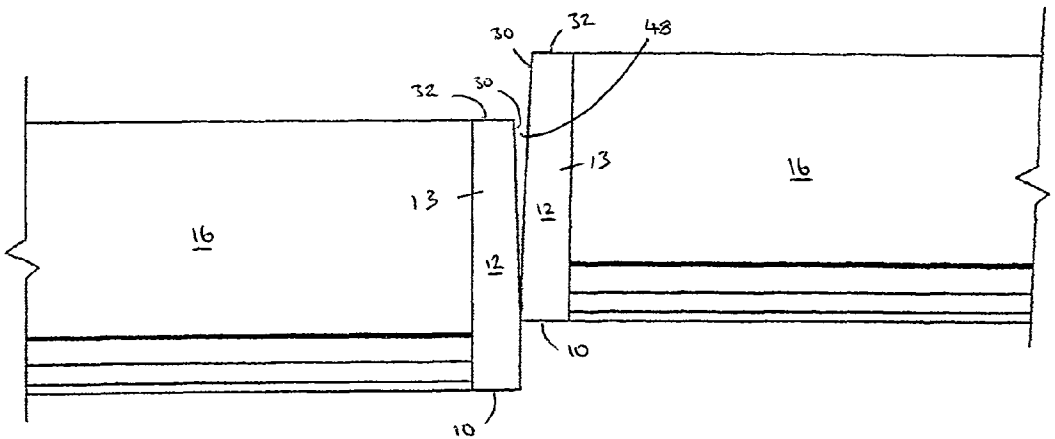

As illustrated most clearly in FIGS. 3(*a*) and 3(*b*) of the drawings, an operatively rear part 30 of the bearing surface 28 of each cap member 12 tapers inwardly towards an operatively rear edge 32 of the cap member 12 to facilitate removal of the sideforms 16 after use.

Figure 2B:
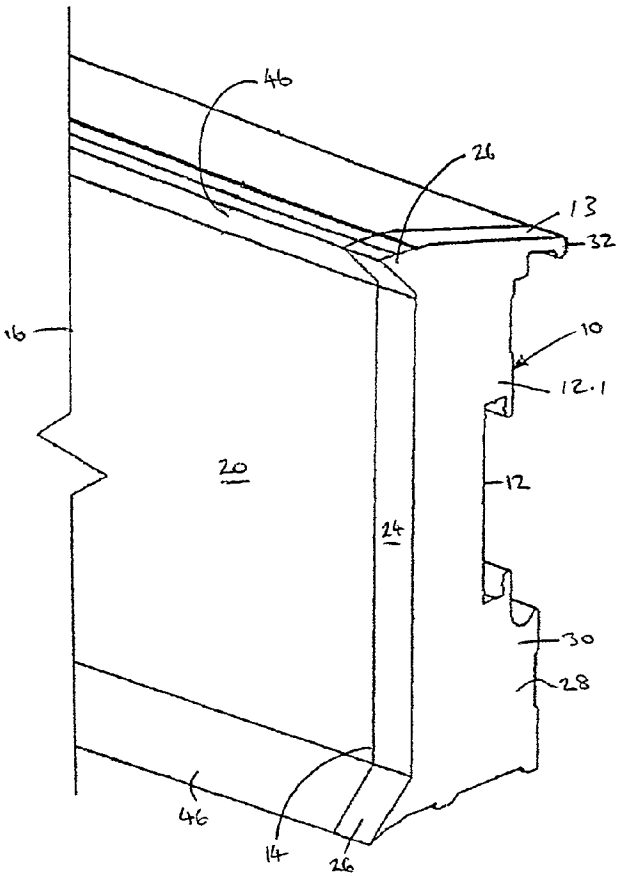
FIG. 2(*a*) illustrates a perspective, exploded view of the accessory of FIG. 1(*a*) and an end of a sideform to be capped by the accessory.
Figure 2A:
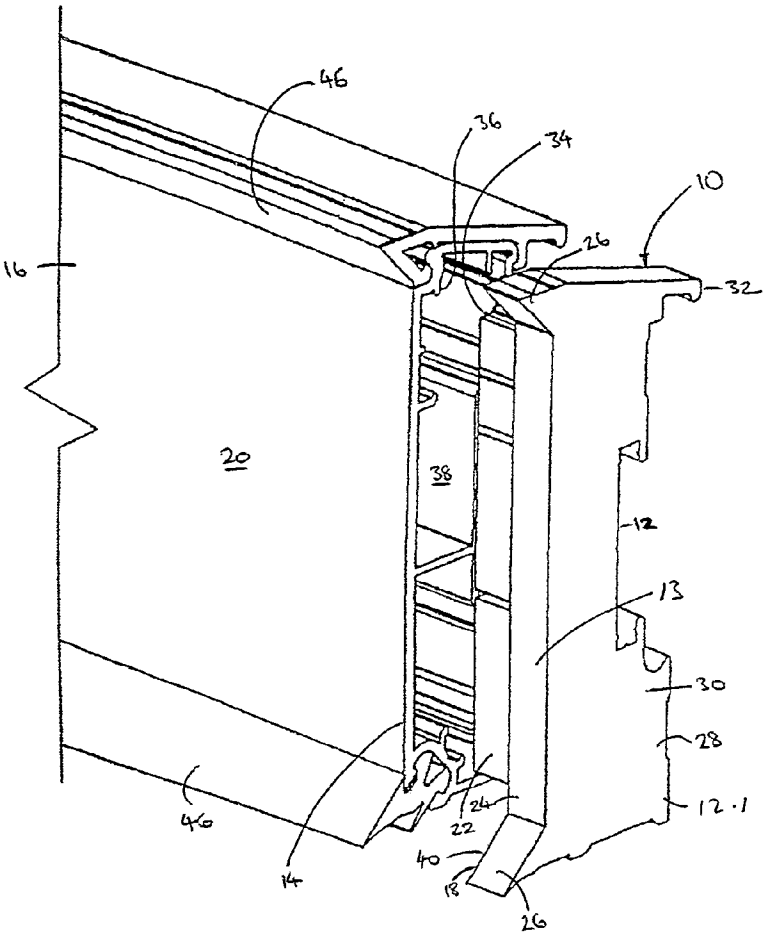

A periphery 34 (FIG. 1(*a*)) of the retaining member 22 complements internal contours 36 of the sideform 16 so that, in use, the retaining member 22 is snugly received in the end 14 of the sideform 16 and inhibits the ingress of material into an interior 38 (FIG. 2(*a*)) of the sideform 16.

The periphery 34 of the retaining member 22 is arranged inwardly of a periphery 40 of the cap member 12 so that an inner surface 42 of the cap member 12 defines a sealing surface arranged about the retaining member 22. In use, the retaining member 22 is received in the end 14 of the sideform 16 with the inner surface 42 of the cap member 12 abutting the end 14 of the sideform 16.

Figure 4B:
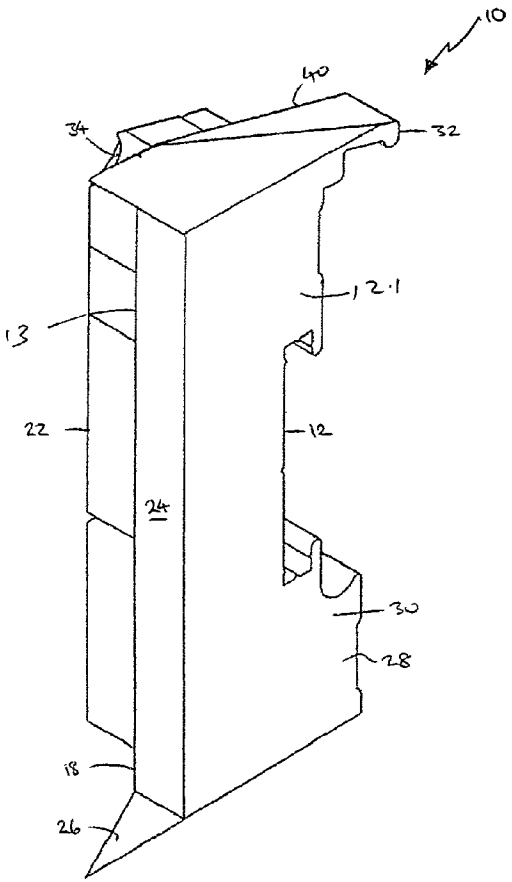
FIG. 4(*a*) illustrates a perspective, rear view of a sideform moulding accessory, in accordance with another embodiment of the invention, for use with sideforms which are to be arranged transversely to each other.
Figure 4A:
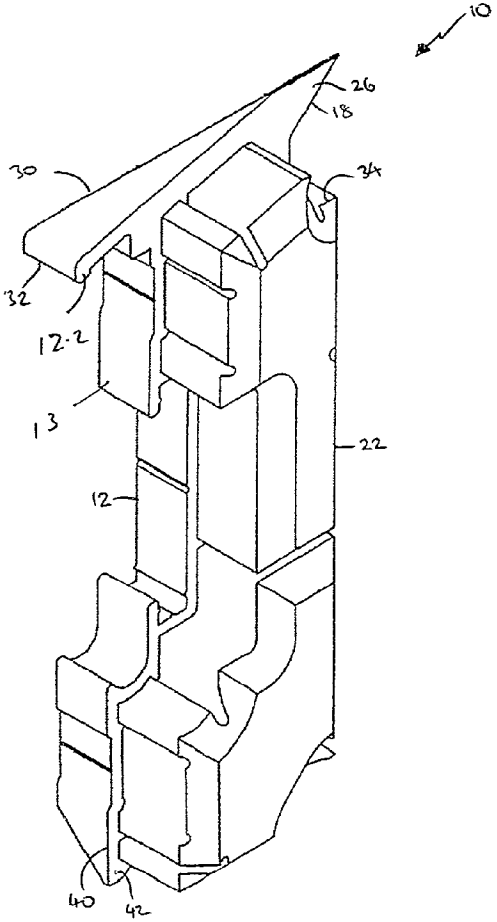
Figure 5B:
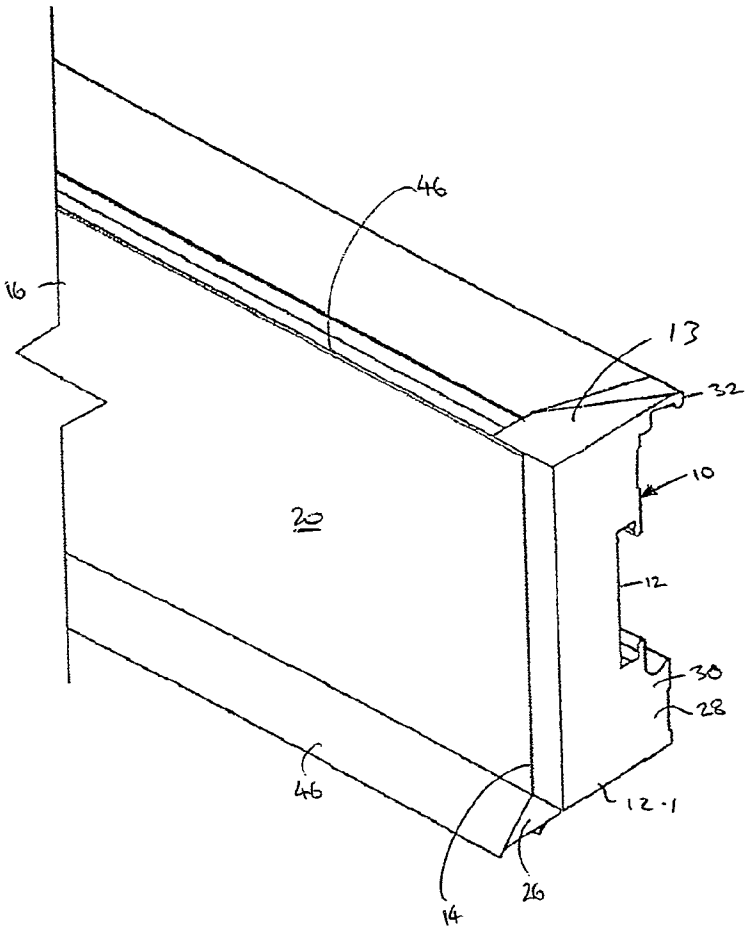
FIG. 5(*a*) illustrates a perspective, exploded view of the accessory of FIG. 4(*a*) and an end of a sideform to be capped by the accessory.
Figure 5A:
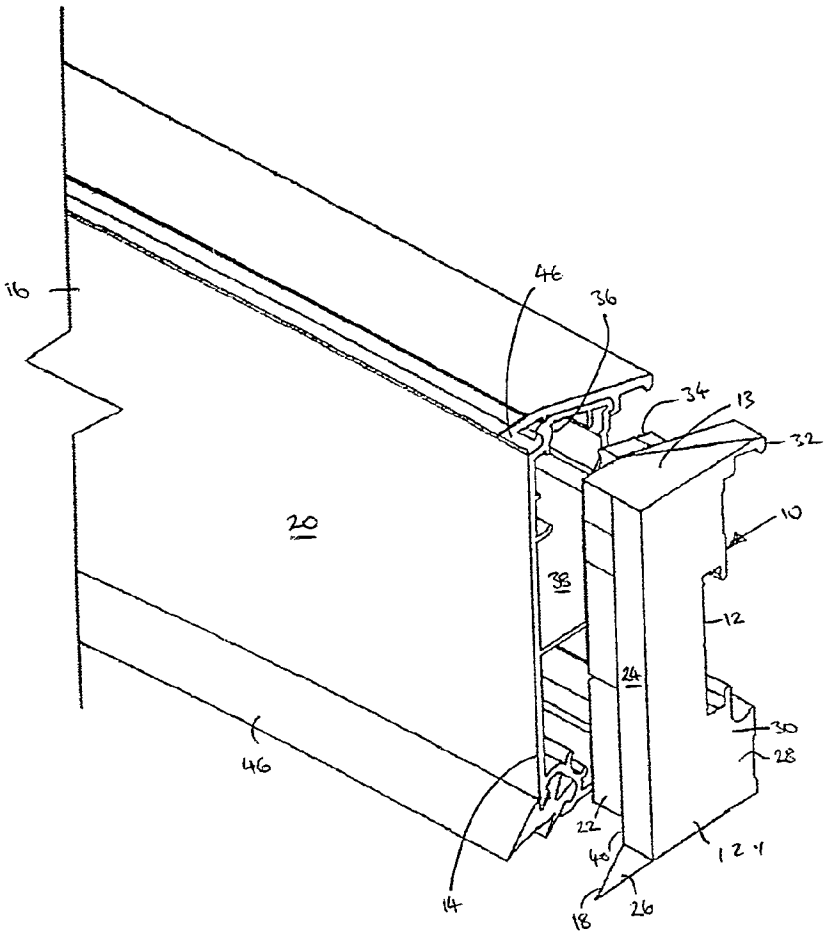

Referring now to FIGS. 4(*a*) to 7(*b*) of the drawings another embodiment of the accessory 10 is shown. With reference to FIGS. 1(*a*) to 3(*b*) of the drawings, like reference numerals refer to like parts unless otherwise specified. In this embodiment, the cap member 12 is configured to facilitate abutment of sideforms 16 arranged transversely to each other.

Figure 6:
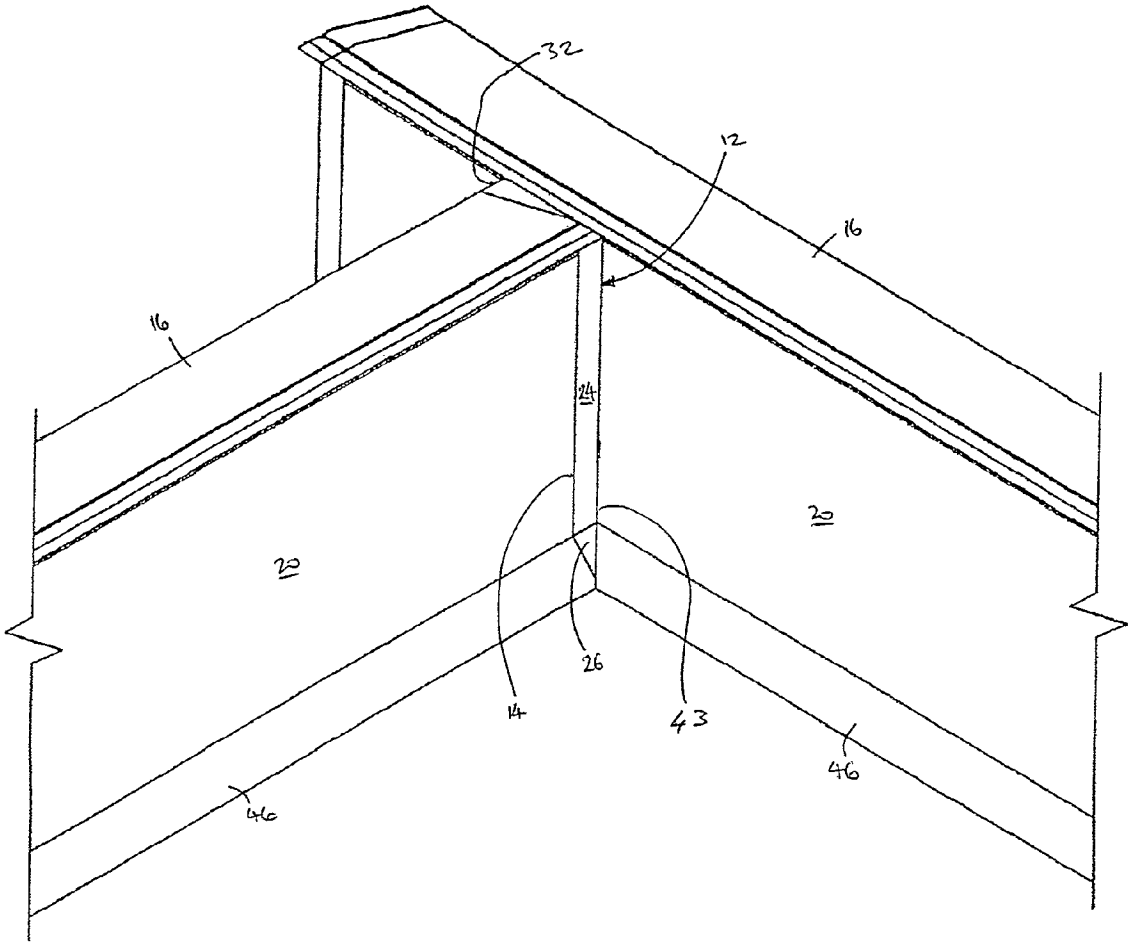
FIG. 6 illustrates a perspective view of an end of a sideform capped with the accessory of FIG. 4(*a*) arranged transversely to and abutting another sideform.

In this embodiment, the bearing surface 28 of the cap member 12 of the capped sideform 16 abuts the moulding surface 20 of the other sideform 16 when a first capped sideform 16 is arranged transversely to a second sideform 16 to form a junction 43 (FIG. 6).

Figure 7B:
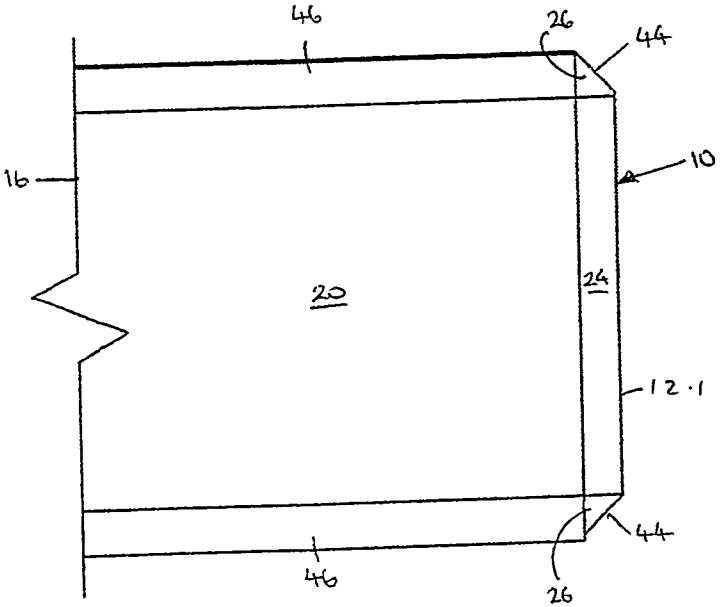
FIG. 7(*a*) illustrates a partial, exploded side view of an end of a sideform and the accessory of FIG. 4(*a*)
Figure 7A:
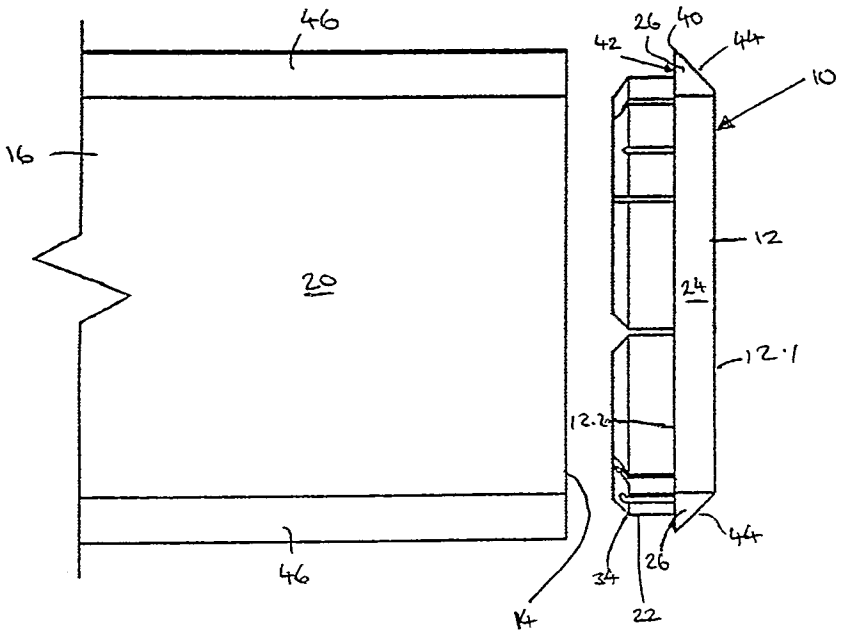

As illustrated most clearly in FIG. 4(*a*) of the drawings, the profile 18 of the peripheral portion 13 of the cap member 12 complements the moulding surface 20 of the sideform 16 which the accessory 10 caps. The profile 18 has an associated surface 24 having chamfered portions 26 to match the moulding surface 20 of the capped sideform 16. However, in this embodiment, the bearing surface 28 is also configured to complement the moulding surface 20 of the second sideform 16 against which the accessory 10 abuts. The bearing surface 28 has bevelled ends 44 (FIG. 7(*a*)) which bear against chamfered portions 46 (FIG. 6) of the moulding surface 20 of the second sideform 16.

In both embodiments, the cap member 12 and the retaining member 22 are formed integrally with each other as a one piece unit. The accessory 10 is moulded of a resiliently flexible material, more particularly, an elastomeric material. Preferably, the elastomeric material is a synthetic rubber.

In use, to achieve a mould having the required length, a plurality of capped sideforms 16 capped with accessories 10 of the first embodiment are arranged in end-to-end abutment so that the associated bearing surfaces 28 of aligned cap members 12 abut against each other. Generally, these sideforms are used to form the longer sides of the mould. The flexibility of the material from which the accessory 10 is formed inhibits gaps forming between abutting parts of the bearing surfaces 28.

The mould is completed by arranging further sideforms 16 transversely to those sideforms 16 establishing the longer sides of the mould. Outer ends of each of the endmost sideforms 16 of the transversely arranged sideforms are capped with accessories 10 according to the second embodiment. The bearing surface 28 of each cap member 12 at the end of the relevant transversely arranged sideform 16 bears against the moulding surface 20 of the relevant longitudinally arranged sideform 16.

The profile 18 of the peripheral portion 13 of the cap member 12 of the accessory 10 of the transversely arranged sideform 16 complements the moulding surface 20 of is associated sideform as well as the moulding surface 20 of the longitudinally arranged sideform 16 against which the transversely arranged sideform 16 abuts. Again, the flexibility of the accessory 10 inhibits gaps forming between the bearing surface 28 and the moulding surface 20 with which the bearing surface 28 is in abutment.

Referring to FIG. 3(*a*), it can be seen that the rear part 30 of the bearing surface 28 is tapered such that when capped sideforms 16 are arranged in end-to-end abutment a V-shaped gap 48 is defined between aligned bearing surfaces 28. Accordingly, the area of contact between the bearing surfaces 28 is minimised.

To cast a concrete panel, a settable concrete mixture is poured into the mould formed by the sideforms 16 and allowed to set to the shape defined by the sideforms 16. After the panel has set the sideforms 16 of the mould are removed. As illustrated in FIG. 3(*b*), one end 14 of the sideform 16 is moved away from the panel as a first step to overcome any resistance to removal of the sideform 16. The end 14 passes through the gap 48 between the tapers 30 as the end 14 moves along an arc, the centre of rotation of which is located at the opposite end 14 of the sideform 16 being removed. The opposite end 14 is then moved away from the panel to complete removal of the sideform 16 from the panel. This also frees up the remainder of the sideforms 16 of the mould which facilitates removal of the remaining sideforms 16.

It is accordingly an advantage of a preferred embodiment of the invention to provide a sideform moulding accessory 10 which aids in arranging sideforms 16 in abutment in order to form a mould for casting concrete panels and, in particular, alleviates the need to modify the ends 14 of the sideforms 16 for re-use.

It is a further advantage of a preferred embodiment of the invention that gaps are inhibited from forming between abutting surfaces such that bleeding of concrete mixture through the gaps is minimised.

It is yet a further advantage of a preferred embodiment of the invention that sideforms 16 can be readily removed from a mould after a panel has set.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A sideform moulding accessory, the accessory including:

a cap member for capping an end of a sideform, the cap member including a pair of opposed sides and a peripheral portion with at least a part of a profile of the peripheral portion configured to complement a mold surface of the sideform; and a retaining member extending from one of the sides of the cap member for retaining the cap member in position relative to the end of the sideform, wherein the other side of the cap member of the pair of opposed sides defines a bearing surface, wherein the bearing surface has beveled ends capable of bearing against chamfered portions of the mold surface of the sideform, wherein an operatively rear part of the bearing surface of the cap member tapers inwardly towards an operatively rear edge of the cap member such that when capped sideform are arranged in end-to-end abutment a V-shaped gap is defined between aligned bearing surfaces, and wherein the cap member and the retaining member are formed integrally with each other as a one piece unit, the unit being a molding of a resiliently flexible material.

2. The accessory of claim 1 in which the profile of the peripheral portion of the cap member is shaped to permit arranging a plurality of capped sideforms in end-to-end abutment.

3. The accessory of claim 1 in which an operatively rear part of the bearing surface tapers inwardly towards the operatively rear edge of the cap member to facilitate removal of the sideform after use.

4. The accessory of claim 3 in which a periphery of the retaining member complements internal contours of the sideform so that the retaining member inhibits the ingress of material into an interior of the sideform, in use.

5. The accessory of claim 4 in which the periphery of the retaining member is arranged inwardly of the peripheral portion of the cap member to define a sealing surface about the retaining member.

6. The accessory of claim 1 in which the profile of the peripheral portion of the cap member is shaped to permit one sideform, carrying the cap member in its end, to be arranged transversely to, and in abutment with, the molding surface of another sideform.

* * * * *